US007112166B2

(12) United States Patent
Brown, Jr.

(10) Patent No.: US 7,112,166 B2
(45) Date of Patent: Sep. 26, 2006

(54) ABDOMINAL EXERCISE ROUTINES USING A FLEXIBLE ELONGATED DEVICE

(76) Inventor: Gordon L. Brown, Jr., 1046 Lady's La., Anderson, SC (US) 29621

( * ) Notice: Subject to any disclaimer, the term of this patent is extended or adjusted under 35 U.S.C. 154(b) by 338 days.

(21) Appl. No.: 10/278,450

(22) Filed: Oct. 23, 2002

(65) Prior Publication Data

US 2004/0082449 A1 Apr. 29, 2004

(51) Int. Cl.
*A63B 26/00* (2006.01)

(52) U.S. Cl. ..... 482/140; 482/907; 482/91

(58) Field of Classification Search ..... 482/140, 482/91, 38, 907, 121–130, 23, 95; D21/687; 434/247, 262

See application file for complete search history.

(56) References Cited

U.S. PATENT DOCUMENTS

| | | | | | |
|---|---|---|---|---|---|
| 145,145 | A * | 12/1873 | Baggs | 119/69.5 |
| 4,107,830 | A * | 8/1978 | Thomson | 29/110.5 |
| 4,542,886 | A * | 9/1985 | Yoshimura et al. | 264/464 |
| 4,826,159 | A * | 5/1989 | Hersey | 272/146 |
| 4,863,159 | A | 9/1989 | Brown, Jr. | |
| 5,004,226 | A | 4/1991 | Brown, Jr. | |
| 5,514,055 | A * | 5/1996 | Elliott | 482/92 |
| 5,643,182 | A * | 7/1997 | Engel | 601/119 |
| 5,674,166 | A * | 10/1997 | Gordon | 482/127 |
| 5,857,945 | A * | 1/1999 | Papp et al. | 482/121 |
| 6,017,297 | A * | 1/2000 | Collins | 482/146 |
| 6,241,644 | B1 * | 6/2001 | Tepperberg | 482/121 |
| 6,379,286 | B1 | 4/2002 | Scopino et al. | |
| 6,432,029 | B1 | 8/2002 | Almeda | |
| 6,450,930 | B1 * | 9/2002 | Kroke | 482/121 |
| 6,475,126 | B1 * | 11/2002 | Hay, Jr. | 482/131 |
| 2002/0193212 | A1 * | 12/2002 | Wu | 482/91 |
| 2003/0045408 | A1 * | 3/2003 | Seles | 482/121 |
| 2004/0067827 | A1 * | 4/2004 | Tustin | 482/121 |

* cited by examiner

*Primary Examiner*—Lori Amerson
(74) *Attorney, Agent, or Firm*—Charles L. Schwab; Nexsen Pruet, LLC

(57) ABSTRACT

A method of exercise and especially for strengthening and toning the abdominal muscles using a flexible elongated device to increase resistance. The device is held at its ends by the hands with the arms in an outstretched position while a person sits with legs bent. The person places the device across and near the near the knees and crunches the abdominals against the added resistance of the flexible elongated device.

9 Claims, 6 Drawing Sheets

ABDOMINAL EXERCISE ROUTINES USING A FLEXIBLE ELONGATED DEVICE

FIELD OF THE INVENTION

The present invention relates to a method of performing exercises intended to firm, strengthen and tone a person's abdominal muscles. The method requires the use of a flexible elongated device which creates resistance during the performance of the exercise routines such that the resistance from the device is transmitted to the abdominal muscles resulting in an enhancement of the muscles.

BACKGROUND OF THE INVENTION

Firming, strengthening and toning the abdominal muscles can improve the health and self-image of an individual. Strong abdominal muscles in combination with a strong back make injury to an individual engaged in physical activity less likely. Runners with conditioned abdominal muscles perform better. Abdominal muscles that are well defined increase a person's physical appearance. A person's confidence is often enhanced if the person feels that he or she is in good shape and a flat stomach with well-defined abdominal muscles enhances this confidence level.

Much money, time and personal effort are expended by thousands of persons on a daily basis trying to achieve well-defined and strong abdominal muscles. The number of exercise routines and exercise devices on the market is large. The personal expenditures per year in the United States alone to strengthen and condition the muscles of the abdomen are in the millions of dollars annually.

Most of the exercise routines used to condition the abdominal muscles are a variation of the sit-up in which a person uses his or her abdominal muscles to move the upper body alone in a direction towards the legs and feet, or in combination with the legs moving toward the chest. A variety of external devices may be used by persons to enhance the conditioning and strengthening of the abdominal muscles. Such devices are: 1) weights placed on a person's chest to add resistance to the contracting of the abdominal muscles when the person's upper body is raised during the sit-up; 2) weights are placed on a person's ankles to enhance the resistance when the legs are raised in conjunction with the raising of the upper body during a modified sit-up; 3) stability balls with diameters between 55 cm and 85 cm are used by persons to create resistance in the abdominal area to strengthen the abdominal muscles; and 4) exercise machines that a person sits into whereby the machine allows resistance to be created in the abdominal area when the person moves so as to reduce the distance between the chest (upper body) and the person's legs.

The disclosed invention provides for a method of performing a modified sit-up using a flexible elongated device which is held by the person's hands and positioned against the person's thigh or thighs close to the knee such that added resistance for the abdominal muscles is created as the person performs the sit-ups.

BRIEF SUMMARY OF THE INVENTION

It is the principal object of this invention to provide an improved method for performing abdominal crunches or sit-ups which incorporates the use of a flexible elongated device which is held by the user's hands or positioned on a modified piece of exercise equipment, such as an 'ParaBody 900 ST abdominal contractor', such that, in all cases, the flexible elongated device is positioned in contact with one or both of the person's thighs slightly adjacent the knees so that when the abdominal crunches or sit-ups are performed, increased resistance is provided by the resistance in bending of the flexible elongated device which enhances the strengthening, conditioning and toning of the abdominal muscles.

It is an additional objective to provide a method for strengthening and conditioning the muscles of the abdomen for the population who do not own exercise equipment and do not belong to a fitness club. This is due to the fact that this method is easy to perform and one that can be performed anywhere the individual has access to a comfortable flat surface or a chair.

Further, it is an object of this invention to provide a flexible elongated exercise device that is easily portable so that the individual can easily take the device in a car or on a plane and perform the exercise routines in his or her bedroom, motel room, gym or any place where they have access to a suitable surface.

In addition, it is an object of this invention to provide a flexible elongated exercise device that has a tailored degree of bending resistance which in combination with the method of performing the exercise allows the user to perform the exercises safely and effectively by minimizing the possibility of straining the muscles of the abdomen or back.

In accordance with the preferred embodiments of the present invention, a flexible elongated exercise device is held at or near each end of the device by the user's hands. The person assumes a position such that the person is able to grasp the flexible exercise device with both hands and position the center part of the exercise device in contact with the front side of the thigh preferably near the knee. This position may be a sitting position or a position with the person lying on his or her back with his or her knees in a raised position. In the sitting position, the person's arms are straight or slightly bent and approximately parallel to the floor or surface with each arm on the outside of the knees and the exercise device positioned on the front of the thighs near the knees. In this sitting position, the body is upright and possibly in a slightly tilted backwards position and the heels of the feet in contact with the surface such as a floor or mat. The legs are bent with the angle between the thighs and calf at about 90 degrees.

If the person is in the position of lying flat on his or her back, the knees will be in the raised position with the thighs substantially perpendicular to the floor, so that the flexible device can be positioned on a thigh close to the knees with the hands on the outside of the knees.

As the person contracts or crunches his or her abdominal muscles to either bring the upper body closer to the knees or moves the knees closer to the chest, or to move the upper body and knees closer simultaneously, the flexible device will bend with the ends pointing in the direction of the user's feet. This bending of the flexible device produces additional resistance for the contracting abdominal muscles resulting in strengthening, conditioning and toning of the abdominal muscles more effectively than that which can be obtained by performing the traditional abdominal crunches without the flexible exercise device.

An exercise machine, in common use today, is referred to as an abdominal roller machine. The individual lies on his or her back and places his or her hands above his or her body on a part of the machine. Many of the machines have a pad for the individual to lay his or her head on. The individual's legs are bent with the angle between the thigh and lower leg of about 90 degrees. The person then contracts his or her abdominal muscles which raises slightly the upper body and then lowers the upper body back to a flat or almost flat position.

The above-described machine and method can be altered by affixing a simple device to the abdominal roller machine so that the flexible exercise device can be laid horizontally in a position such that the raised legs will contact the flexible bar about at the knees such that when the individual performs the crunch, the legs will press against the center of the device creating resistance for the contracting of the muscles of the abdomen and thereby enhancing the strengthening, conditioning and toning of the abdominal muscles.

Another aspect of this invention is the use of a flexible elongated device formed as a pultruded composite material wherein the majority of reinforcing fibers, which are preferably glass fibers, are aligned in the longitudinal direction such that when the pultruded composite is bent, as described above, the resistance to bending will progressively increase as the pultruded composite is bent in a greater arc and as such the strengthening benefits to the abdominal muscles will be further enhanced. While resistance can be created with the use of a device that does not contain a pultruded composite as described above, the incorporation of a pultruded composite as all or part of the device allows for more effective strengthening, conditioning and toning of the abdominal muscles. Depending on the needs of the user a variety of flexible elongated devices may be used. An example of a device that would not contain a pultruded composite is a round extruded rod with a diameter from about ⅜" to about ¾" made from an engineered thermoplastic such as a nylon or acetal resin.

A preferred embodiment features an extruded thermoplastic tubular device such as extruded PVC or a thermoplastic rubber that has a cavity of a given shape in the center. The thermoplastic will have a durometer such that the product feels comfortable when placed onto the surface of the front of the person's thigh. It should not be too hard. Into this cavity will be inserted a consistent cross-section pultruded composite substantially the length of the extruded thermoplastic round shape. The product may have a thermoplastic end-cap placed on each end. This constitutes the preferred embodiment although within this description many changes can be made to one or more of the components of the device without affecting the functionality for which it is designed.

DETAILED DESCRIPTION OF THE INVENTION

Figure 1:
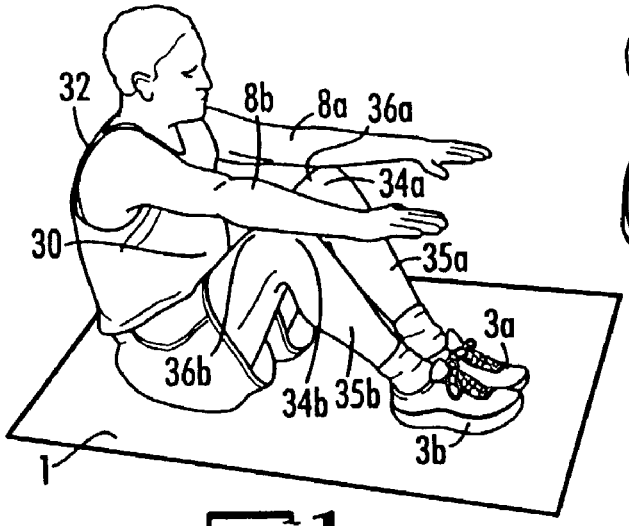
FIG. 1 is an illustration of the beginning position for this exercise method with the individual sitting on a surface with the knees raised and legs bent with the arms straight out and parallel to the surface and the upper body in the raised position and slightly tilted backward.

The present invention will now be described in detail hereinafter by reference to the accompanying drawings. The invention is not intended to be limited to the embodiments described; rather, this detailed description is included to enable any person skilled in the art to strengthen, condition and tone the abdominal muscles by performing the described exercise methods using a flexible resilient exercise device as described herein.

A flexible elongated device may be defined as any elongated body or other structure that will bend and provide sufficient resistance to the user as the user's hands press against the ends of the flexible device with the center portion of the device positioned against one or both of a person's thighs slightly above the knees. The definition also reads on a device such that when the user's hand or hands press against the center of the flexible exercise device with the ends of the device positioned against each thigh slightly above the knees, or as the user's hands are positioned in contact with a part of a mechanical device, used to assist in performing an abdominal crunch, and the flexible device is positioned on the mechanical device such that one or both knees contact the surface of the flexible device such that the flexible device will bend and provide resistance when the individual contracts the abdominal muscles and minimizes the distance between the knees and chest of the individual.

By reference to the figures, the abdominal muscles 30 experience increased resistance when they contract in the exercise movement of raising the upper body 32 towards the knees 34*a*, 34*b* in which the legs 35*a*, 35*b* are bent in a position so that the flexible exercise device can be positioned on the front of the thigh near the knee so that the arms 8*a*, 8*b* which are in a straight or bent position can exert a force against the ends of the flexible device to bend the flexible device against the front of the thigh 36*a*, 36*b*. In addition, the bent legs, at a location above the knees on the front side of the thigh 36*a*, 36*b*, can move against the surface of the flexible exercise device in the direction of the individual's chest whereby resistance is created in the hip flexors 31*a*, 31*b* and abdominal muscles 30. The essential elements of all of the routines of the methods for strengthening, conditioning and toning the abdominal and related muscles, such as the hip flexors, is the positioning of a flexible exercise device 10, which is held at or near the ends of the device by both of the individual's hands 22*a*, 22*b*, against the front of the individual's thigh 36*a*, 36*b* near the knee, such that the individual's upper body 32 can move a distance toward the individual's knees 34*a*, 34*b* as the muscles of the abdomen 30 are contracted to raise the individual's upper body, and by doing so, the straight or bent arms 8*a*, 8*b*, which are positioned such that the hands are located on the outside of the individual's knees 34*a*, 34*b*, exert a force against the ends 24*a*, 24*b* of the flexible exercise device and bend the flexible exercise device a distance that allows the individual's upper body to move a distance in the direction of the individual's knees. The bending of the flexible exercise device 10 creates resistance that promotes the strengthening of the abdominal muscles 30. Moving the knees against the flexible exercise device also results in bending of the device and also promotes strengthening of the abdominal muscles 30 and also other muscles such as the hip flexors 31*a*, 31*b*. The exercise device must be flexible in order to allow movement of the individual's upper body towards the individual's knees and also movement of the individual's knees towards the individual's chest.

An alternative to the above described method involves positioning both (although one hand can be used) hands near the center 11 of the flexible exercise device with the hand or hands between the knees. Again, the arms are straight or bent and when the upper body is raised due to the contraction of the abdominal muscles, the flexible device bends in the center creating resistance in much the same manner as the positioning of the hands at or near the ends of the flexible device with the hands on the outside of the knees.

Below is described the preferred embodiment of a method for strengthening, conditioning and toning the abdominal muscles which includes all of the essential elements as described above. Many other variations and modifications may be made to the below described methods by those having experience in this technology without departing from the concept of the present invention. Accordingly, it should be clearly understood that the apparatus and methods depicted in the accompanying drawings and referred to in the foregoing description are illustrative only and are not intended as limitations on the scope of this invention.

The individual should perform a couple of minutes of general warm-up exercises including mild stretching before beginning the exercise routines. This is to loosen the muscles in the abdominal region and the back.

To effectively perform the exercise routines, the person should have a relatively flat surface such as a carpeted floor or an exercise mat. In addition, the individual should:

- Wear comfortable exercise clothing that will allow freedom of movement when performing the modified sit-ups as explained below.
- Have a flexible exercise device that will bend a sufficient amount to allow movement of your upper body and provide a sufficient amount of resistance.
- Assume a sitting position (FIG. 1) with the knees bent comfortably at about a 90 degree angle with the heels of both feet on the floor, ground, carpet or mat 1 for beginning each of the routines. Your feet 3*a*, 3*b* can be flat against the floor. In this position, you will probably feel more comfortable with your torso (upper body) slightly tilted backwards. The back should be kept as straight as practical. The knees should be a comfortable distance apart (4"–16" is good for most people), although the knees can be touching.

Routine #1

Figure 2:
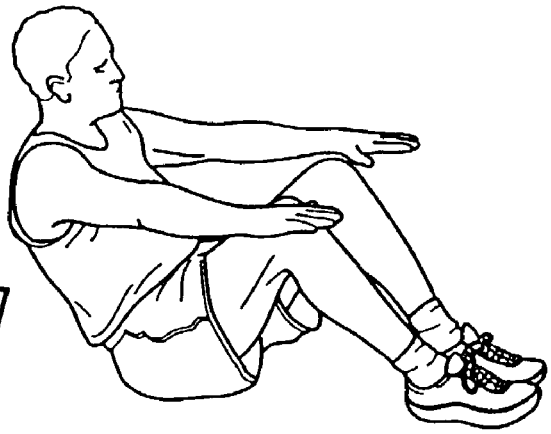
FIG. 2 is an illustration of a beginning routine in which the individual leans backward until his or her feet feel like they will come up off the surface. This routine is performed without the flexible elongated device. This routine is intended to help stretch and loosen-up the back and abdominal muscles.

In this position, your arms should be straight out and parallel to the floor. Let your upper body go backward slowly (keeping your back as straight as practical) until your feet (or heels) feel like they are going to come up off of the floor (FIG. 2). A tightening may be felt in the abdominal area. This is the purpose of this movement. Raise the upper body to a starting position with the heels still on the floor. Now lean back again until the feet feel like they are going to come up off the floor and then raise up to return to the starting position. Start at 5 repetitions and over several days work up to 10 reps.

Figure 3:
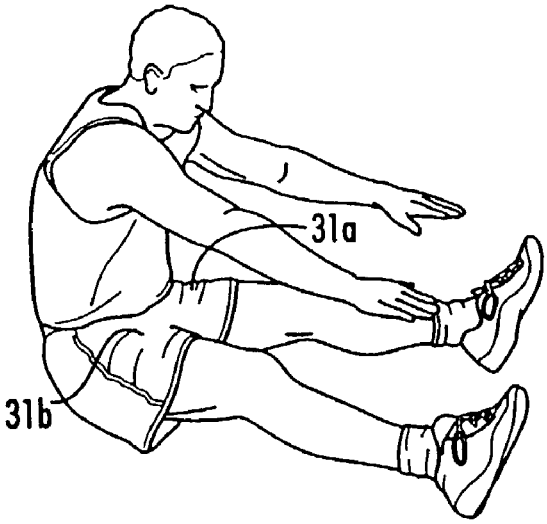
FIG. 3 is an illustration of a stretching routine performed without the elongated flexible exercise device.

At the end of the above routine, straighten out the legs and lean the body forward with arms outstretched (FIG. 3). Move the hands in the direction of your toes. This stretching should reduce any feeling of strain or tightness in the lower back.

Figure 4:
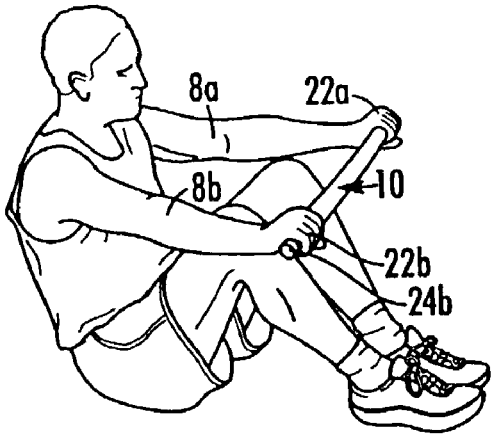
FIG. 4 is an illustration of the beginning position for the individual in which the elongated flexible exercise device is held at or near the ends of the device by the hands with the person's knees between the device and individual's chest.

Now the individual is ready to begin a routine using the flexible exercise device and practice the method that is taught by this invention. While in the sitting position, place the hands 22*a*, 22*b* apart and at opposite ends 24*a*, 24*b* of the flexible exercise device 10 with arms straight or bent slightly and parallel to the carpet. At this point, the knees should be between the chest and the flexible exercise device (FIG. 4).

Routine #2

Figure 5:
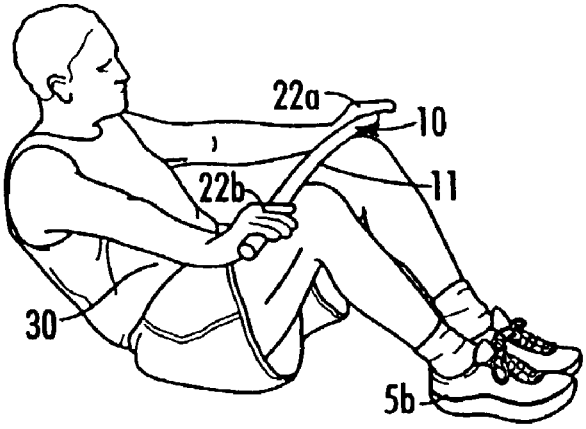
FIG. 5 is an illustration of the beginning position of the method of exercise intended to help strengthen the muscles of the abdomen using the flexible exercise device which is held by the hands, at or near the ends of the exercise device, with the exercise device placed on the front side of the thigh near the knees with the arms straight or slightly bent at the elbows.

Start leaning backward slowly. As the person leans back slightly the arms are raised to allow the flexible exercise device to pass over the top of the knees, 34*a*, 34*b*. NOTE: When first starting this exercise, a person may not be able to lean far enough back for the flexible exercise device to come all the way over the knees without the feet coming off of the floor. The goal is to be able to lean back so that the flexible exercise device is over the top of the knees and you can lower the device to a position slightly above the knees (FIG. 5). NOTE: If the person has trouble getting the flexible exercise device far enough behind the knees, lowering the legs slightly will move the knees slightly forward, or, the person can bend their arms and place the flexible device against the front of the thigh near the knee and then straighten back out the arms or leave them slightly bent.

Figure 6:
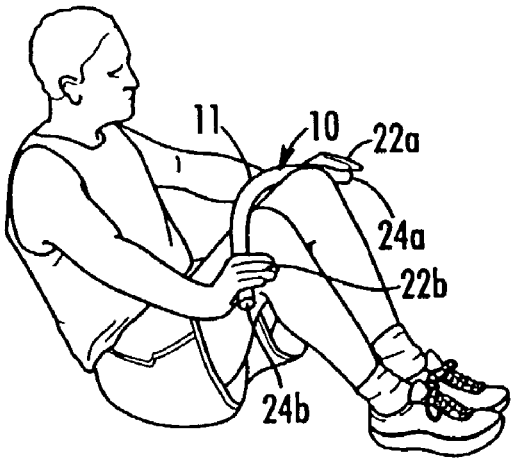
FIG. 6 is an illustration of resistance being created by the bent bar in response to the raising of the upper body by the contracting or crunching of the abdominal muscles with the position of the feet held constant.

With the flexible exercise device positioned against the thigh and slightly above the knee (FIG. 5), start raising the body, using the abdominal muscles 30 towards the knees keeping the heels in their original position. It will be noticed, almost immediately, and the increased resistance will be felt in the abdominal area. This resistance comes from the extended straight (or slightly bent) arms exerting a force against the ends of the flexible exercise device. As this force is exerted against the ends of the device, the ends of the device will move in the direction of the feet and the middle 11 of the device will be bent backwards in the direction of the chest (FIG. 6). During this movement, the position of the legs (and heels) does not change. As the upper body moves in the direction of a more upright position, the resistance provided by the flexible exercise device will increase as will the tightening of the muscles in the abdominal area. The person should continue to sit up only as long as the increasing tightening of the muscles in the abdominal area feels comfortable. Repetitions at a low resistance level may be upgraded to increase resistance and reps over time. Also, the hands can be moved closed together on the flexible exercise device with the knee or knees still between the hands, to further increase the resistance. When a comfortable upright position is reached (not too much resistance), the position should be held for a count of three (3). Then, let the body lean back until the flexible exercise device is in the original straight (or slightly bent) position touching the thigh and slightly above the knee. Then raise the body upwards again until an upright position is reached that is comfortable.

Figure 7:
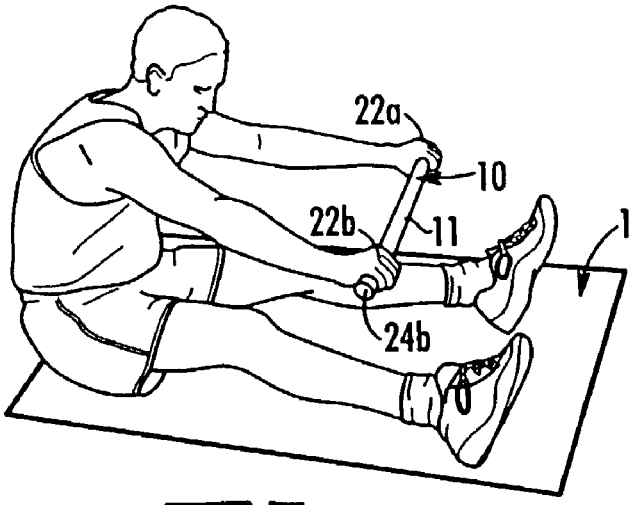
FIG. 7 is an illustration of a stretching routine using the exercise device.

At the end of each set of repetitions, perform the stretching as described in Routine 1 above but with the flexible exercise device 10 held at the ends 24*a*, 24*b* by your hands 22*a*, 22*b* (FIG. 7).

Routine #3

Figure 8:
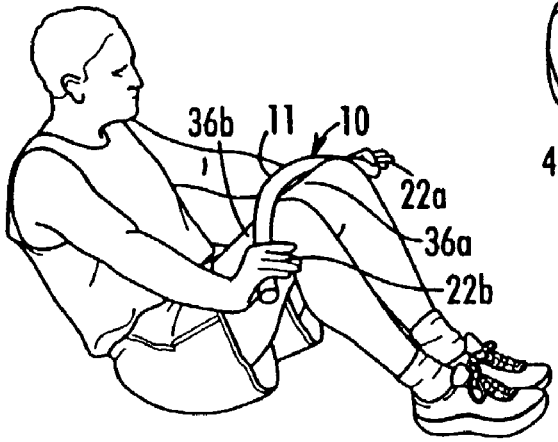
FIG. 8 is an illustration of resistance being created by the bending of the device in response to movement of the upper body toward a more upright position by the contraction or crunching of the abdominal muscles together with movement of the legs against the middle of the exercise device toward the individual's chest.

This is a variation of Routine #2. With the flexible exercise device positioned slightly above the knees, as in routine #2, move the upper body forward towards the more upright sitting position. The hands will again be pressing on the ends of the flexible exercise device as the device presses against the thighs slightly near the knees. When a position is reached in which the tightness in the muscles of the abdomen is moderate, but not strong, begin to move the bent legs against the flexible exercise device in the direction of the chest. This movement requires a degree of coordination and will become easier as one becomes comfortable with this routine. The bottom of the heels should slide across the surface of the floor or mat as the legs are drawn towards the chest. With a very small amount of movement of the legs (½" to 1") towards the chest, the person will notice that the tightening of the abdominal muscles will increase significantly. This is enhancing the strengthening of the abdominal muscles over that which was achieved in Routine #2 above. When the person has brought the legs to the position where the tightening of the abdominal muscles feels like it is at the maximum comfortable level, the position should be held for a count of three (3) (FIG. 8). Now, move the legs and heels in the opposite direction back to the position at which the legs started while keeping the upper body in its current position (positioned forward producing moderate but not strong tightness in the muscles of the abdominal area).

Start initially at 3 repetitions and work up to 10 reps over a couple of weeks. At the end of each set of repetitions, perform the stretching as described in routine #1 above but with the flexible exercise device held at the ends by your hands (FIG. 7).

Routine #4

This routine combines the movements of Routines #2 and #3 above. Begin moving the upper body forward at the same time that the legs are moving in the direction of the chest. The device is being held at each end by the hands with the middle 11 of the device positioned against the thigh slightly near the knee (FIG. 5). During this movement, the heels 5*a*, 5*b* of your feet will be sliding at the surface of the floor, carpet or mat. As the person does this routine, they will feel as though they are using the buttocks as a pivot with the upper body moving up and back in conjunction with the legs moving towards the chest and then away, respectively.

Start initially at 3 repetitions and work up to 10 reps over a couple of weeks. At the end of each set of repetitions, perform the stretching as described in Routine 1 above but with the flexible exercise device held at the ends by the hands (FIG. 7).

Routine #5

This routine is a variation of Routine #3 above. The starting position for this routine is when the person is in the position of maximum comfortable tightness of the abdominal muscles with the upper body in the up position and the legs moved towards the chest (FIG. 8). At the start of this movement, both heels 5*a*, 5*b* should be on a carpet or mat. Start by sliding the right leg 35*b* and heel 5*b* slightly towards the chest (a distance of ½" to 1" is a good guide) and then back to its starting position. Then slide the left leg 35*a* slightly towards the chest and then back.

Start initially at 3 repetitions and work up to 10 reps over a couple of weeks. At the end of each set of repetitions, perform the stretching as described in routine #1 above but with the flexible exercise device held at the ends by your hands (FIG. 7).

Routine #6

Figure 9:
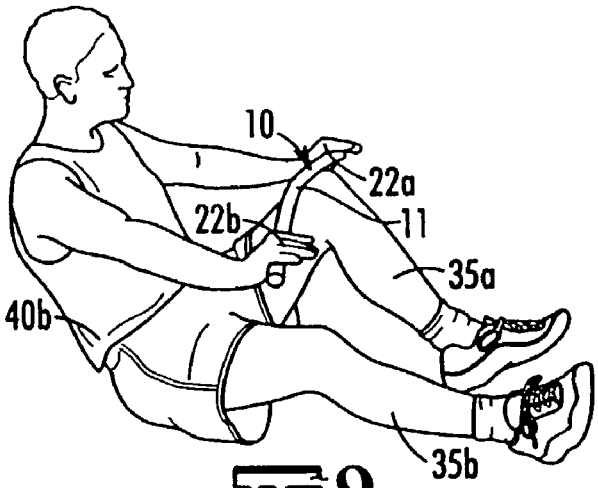
FIG. 9 is an illustration showing the start of an exercise routine in which only one leg is in the raised and bent position with the other leg flat or slightly bent to provide added stability.
Figure 10:
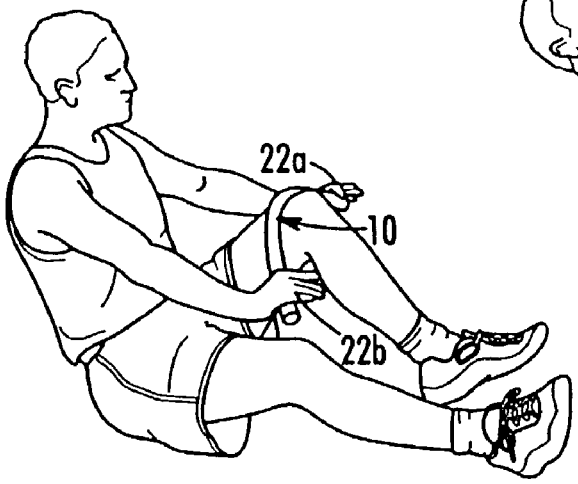
FIG. 10 is an illustration showing resistance being created by the bent bar in response to the raising of the upper body by the contracting or crunching of the abdominal muscles, with a focus on the oblique muscles, as the exercise device is bent across the raised knee.

This routine uses just one (1) leg 35*a* or 35*b* (FIGS. 9 and 10). FIGS. 9 and 10 correspond to FIGS. 5 and 6 which show the routines using both legs. Using just one leg allows the person to focus resistance on either the left oblique 40*a* or right oblique 40*b* corresponding to the use of just the left or right leg respectively. Also, using just one leg makes the routines a little easier to perform because the other leg provides a degree of stability. The user can perform the movements as outlined in Routine #2, 3, 4 and 5 above using just one leg and then switching to the other leg.

For this routine, start initially at 3 repetitions and work up to 10 reps over a couple of weeks. At the end of each set of repetitions, perform the stretching as described in Routine #1 above but with the flexible exercise device held at the ends by your hands (FIG. 7).

The individual is advised to work up to at least 5 repetitions for Routines #2, 3, 4 and 5 using both legs before starting the routines using just one (1) leg. Of course, the individual may start the exercise routine using just one leg and when they have worked up to at least 5 repetitions, start with the routines using both legs.

Routine #7

Figure 11:
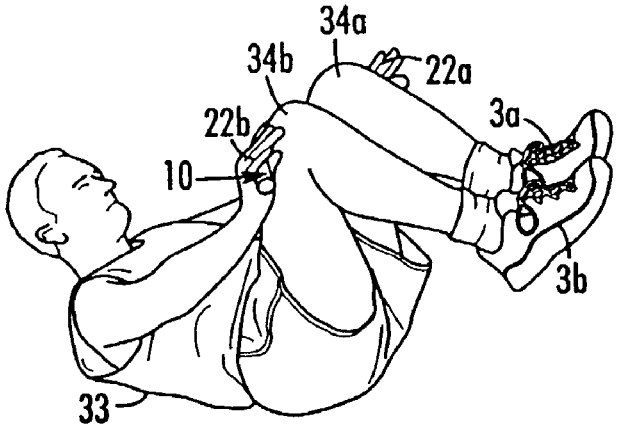
FIG. 11 is an illustration showing an exercise routine in which the person's back is against the surface, with the head flat on the surface or slightly raised off of the surface, with the legs raised and bent so that the exercise device which is held at each end by the individual's hands is bent across the front of the individual's thighs near the knees as the individual's abdominal muscles are contracted.

This routine is performed with the user lying on his or her back 33, feet 3*a*, 3*b* off the ground 1 and with the knees 34*a*, 34*b* brought towards his or her chest as in FIG. 11. Many people currently perform a 'sit-up crunch' in which the abdominal muscles are contracted in order to raise the upper body off of the floor a slight distance. This routine is intended to be similar to the 'crunch' but the knees will be in the raised position (FIG. 11) with the flexible exercise device against the thigh, slightly near the knees. As the upper body is raised up slightly upon the contracting of the abdominal muscles, added resistance will be felt in the abdominal muscles by the hands bending the device towards the feet.

For this routine, start initially at 3 repetitions and work up to 10 reps over a couple of weeks. At the end of each set of repetitions, perform the stretching as described in routine #1 above but with the flexible exercise device held at the ends by your hands (FIG. 7).

The individual is advised to work up to at least 5 repetitions for Routine #2, 3, 4 and 5 using both legs before adding the routines using just one (1) leg or this routine with the user's back flat on the floor. Of course, the individual may start the exercise routine using just one leg and when they have worked up to at least 5 repetitions, may start with the routines using both legs or this routine #7. It is suggested that this routine be used, not as an addition to the above routines, but as an alternative to add variety to the workout.

After several weeks of performing the above routines, a person should have completed a full set of repetitions (starting at 3 reps and working up to 10 reps, or a number less than 10 that is comfortable) for each of the routines above. The routines should be performed several times per week, as part of a regular exercise program, and these routines will help give the strong, firm and toned abdominal muscles that are desired.

Figure 12:
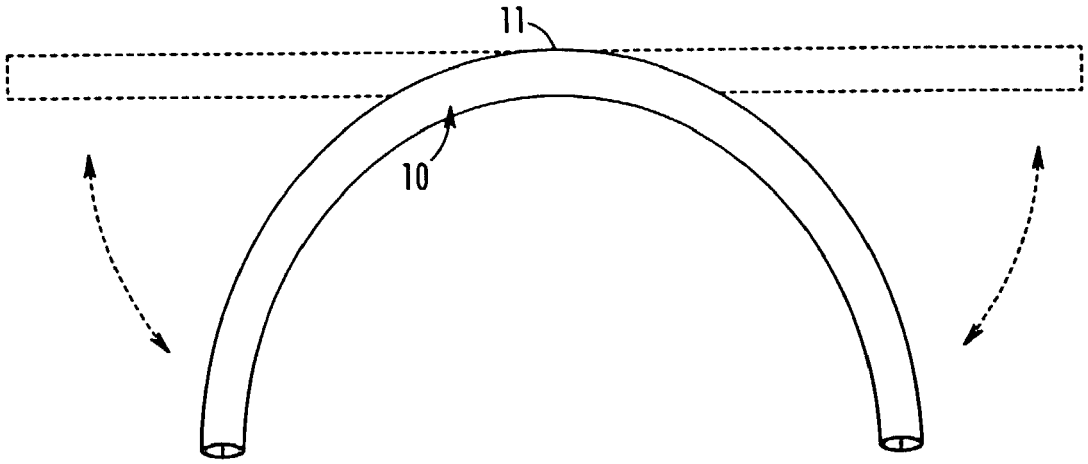
FIG. 12 is an illustration of the exercise device bent into the shape of a semi-circle which is the maximum amount of useable bend.

The flexible exercise device 10 must have sufficient flexibility to bend a distance that is sufficient to allow the individual to raise the upper body a sufficient distance as the abdominal muscles 30 contract. If a very rigid device, such as a steel pipe about one inch in diameter were used, the individual would not be able to raise the upper body a sufficient distance, and the user would be performing essentially an isometric exercise which would not allow the muscles of the abdomen to contract and strengthen in the manner as is described in this invention. Alternately, the flexible exercise device must be of sufficient stiffness to provide an amount of resistance, when bent, to strengthen, condition and tone the abdominal muscles. FIG. 12 illustrated the maximum bending which may be obtained. The degree of stiffness of the flexible exercise device depends on the preference of the individual user. Below, a preferred embodiment for the flexible exercise device is described. This preferred embodiment would allow the vast majority of individuals to perform this method's invention in a manner that is satisfactory. As will be pointed out, many alternative designs for the flexible elongated device are possible to create a device with more or less flexibility and the resulting amount of resistance.

A preferred embodiment of the flexible exercise device (FIGS. 13 and 14) consists of an elongated substantially rectangular shaped pultruded composite rod 42, constructed from a hardenable mixture of resin and preferentially longitudinally oriented continuous glass fiber filaments, capable of being bent into the shape of a semi-circle a minimum of 80,000 times without substantial cracking of the elongated rectangular shape. A material having low hysteresis is preferred for consistency. A suitable elongated device 10 will be about 40 inches in length with an outside diameter of about 1 5/16". The device will have a pultruded composite core with the dimensions of 0.1875"×0.500"×40 inches as in FIG. 14 with the edges of the pultruded composite core 42 containing full radius ends 40. The core 42 has a major and a minor axis, 41 and 43, and is preferably constructed using Owens-Corning Fiberglas "E-glass" continuous roving with the resin matrix being a vinyl ester resin. The resin could alternatively be an epoxy resin, isophthalic polyester or other resin selected to give an acceptable flexural modulus and flexural fatigue performance in bending. A pultruded resilient composite core of the preferred embodiment is made by Glasforms, Inc. of San Jose, Ca. Covering the pultruded composite rectangular core will be a coaxially positioned sheathing 50 consisting of an injection molded polyurea material from Expandable Products, Inc. of Smyrna, Georgia producing an intermediate round shape of an approximate ¾" outside diameter. Then, soft, foam sleeves 60 from Hunt-Wilde Corp. of Tampa, Fla. are slid over the outside of the round shape 50 the full length of the device to give the exterior of the device a soft feel against the individual's legs. The ends of the device may include a vinyl end cap about 1" in length with an i.d. of about ¾ to fit over each end of the round shape 50, as made by Sinclair Rush, Mocap or Malish Brush Co., etc. The finished outside diameter of the flexible exercise device is about 1 5/16".

Figure 15:
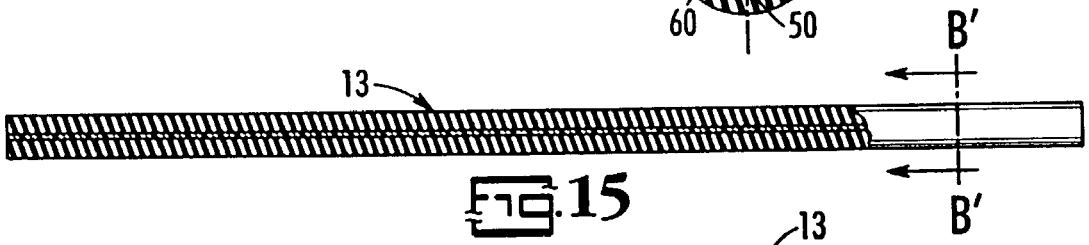
FIG. 15 is a cross-sectional view of FIG. 13 illustrating an alternative embodiment of the flexible elongated exercise device.
Figure 16:
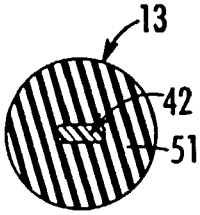
FIG. 16 is a sectional view along section line B'—B' similar to FIG. 14, illustrating another embodiment of the device used in performing the routines of this invention.

An alternative design for the flexible elongated device 10 may be used so long as the functional characteristics of the flexible elongated device are maintained. For example, FIG. 15 illustrates a flexible elongated device 13 which uses the same pultruded composite core 42 of FIG. 13 but the sheathing material 51 is an extruded thermoplastic material such as thermoset rubber, thermoplastic rubber, PVC, etc.

Figure 13:
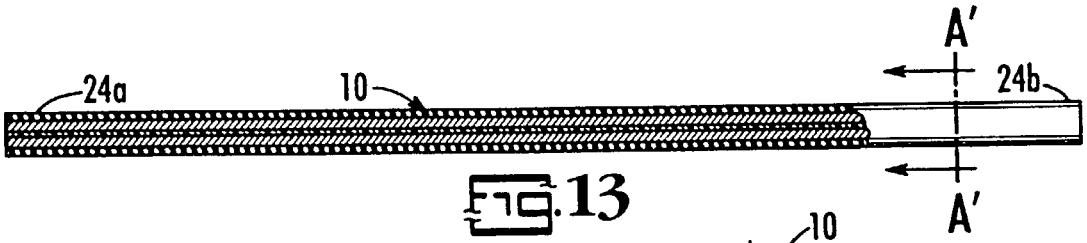
FIG. 13 is a cross-sectional view of a flexible elongated exercise device according to this invention.
Figure 14:
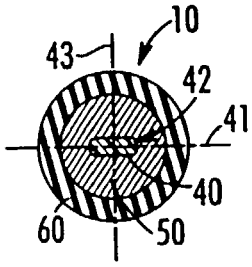
FIG. 14 is a sectional view along section line A'—A' (FIG. 13) of the flexible elongated device of FIG. 13.
Figure 17:
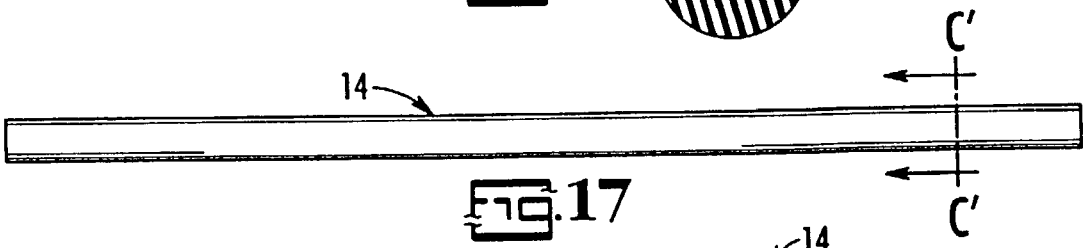
FIG. 17 is a drawing similar to FIG. 13 illustrating an alternative embodiment of the flexible elongated exercise device.
Figure 18:
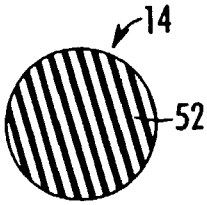
FIG. 18 is a cross-sectional view along section line C'—C' (FIG. 17), illustrating the alternative embodiment of the device used in performing the routines of this method's invention.

Another alternative design 14 for the flexible elongated device 10 of FIG. 13 is illustrated in FIG. 17. In this design the device consists of only a crystalline thermoplastic extruded material 52 such as Delrin®, manufactured by Dupont which is an acetal homopolymer. Other suitable thermoplastic materials are Nylon 6/6, Zytel® ST801 (super tough nylon), Nylon 6/12, and Nylon 6/6 with about 30% glass fibers. Thermoplastic rubbers, such as Santoprene® by Monsanto are acceptable. Depending on the resin selected the diameter of the rod-like elongated device will need to be adjusted to take into account the flexural modulus of the resin selected in order to give the device the desired amount of bending stiffness.

Figure 19:
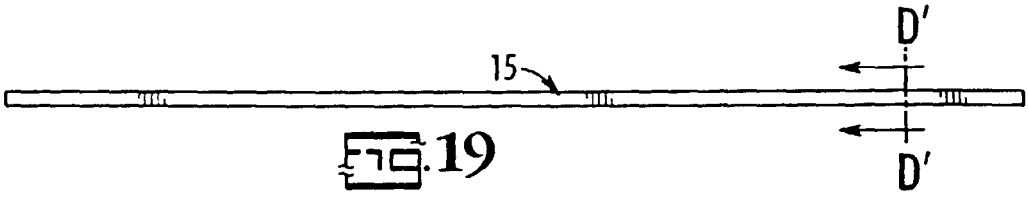
FIG. 19 is a drawing illustrating an alternative embodiment of the flexible elongated exercise device.
Figure 20:
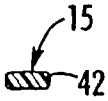
FIG. 20 is a cross-sectional view along section line D'—D' of FIG. 19 of the flexible elongated device.

Another alternative design 15 for the flexible elongated device 10 is illustrated in FIG. 19. In this design the pultruded composite core 42 serves as the flexible elongated device 15.

Figure 21:
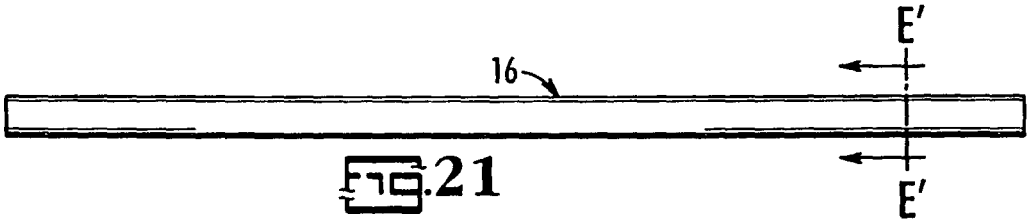
FIG. 21 is a drawing illustrating an alternative embodiment of the flexible elongated exercise device.
Figure 22:
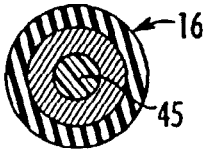
FIG. 22 is a cross-sectional view along section line E'—E' of FIG. 21.

FIG. 21 illustrates yet another version of the flexible elongated device. In this embodiment, device 16 is similar to device 10 of FIG. 14 except that core 42 has been replaced by a solid round pultruded composite rod 45.

Figure 23:
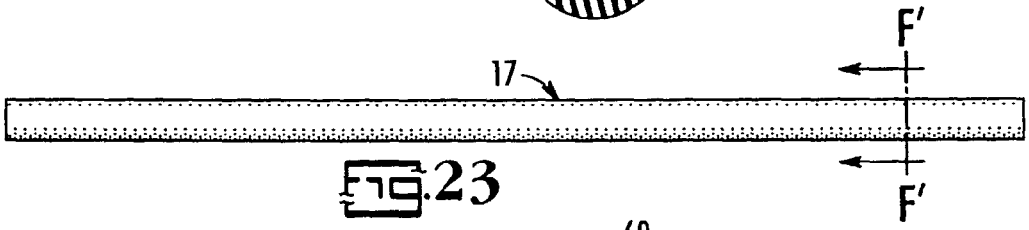
FIG. 23 is a drawing illustrating an alternative embodiment of the flexible elongated exercise device.
Figure 24:
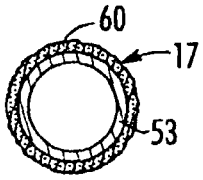
FIG. 24 is a cross-section view along section line F'—F' of FIG. 23 of the flexible elongated device.

FIG. 23 illustrates yet another version of the flexible elongated device. In this embodiment, device 17 is similar to device 16 of FIG. 21 except that core 45 and the coaxially positioned sheathing 50 have been replaced by a hollow tube 53, which may be formed from PVC or, preferably, CPVC as discussed below.

The above described embodiments for the flexible exercise device are merely illustrative of the principles of the invention. It will be apparent, for example, that the components of the flexible exercise device could be of a different shape and size, such as having a finished rectangular, triangular or octagonal shape. The external shape of the finished flexible elongated device can consists of a variety of shapes within the same device in order to accommodate such functional aspects as possibly flat or curved places for positioning the device against the knees. This varying of the shape of the finished external device is particularly applicable when injection molding or casting of a polymeric material around a rectangular, square, or round core shape. The materials from which the flexible exercise device is made could be changed, for example, to a flexible extruded PVC pipe with an outside diameter of about ¾", a wall thickness of about ⅛" and a length of about 40", a CPVC pipe with an outside diameter of about ⅝", a wall thickness of about 0.075" and a length of about 40", a pultruded solid round rod with a diameter of about 0.25" and a length of about 40", or a small diameter solid carbon steel rod of sufficient flexibility to be bent the proper amount necessary to practice this method's invention, or the sheathing can be an extruded closed cell polypropylene with a density of 1.6 pounds per cubic foot as made by PACTIV Corporation of Lake Forest, Ill. The core material of the above described preferred embodiment, a pultruded 0.1875"×0.500"×40" elongated bar can be used in the performance of this method's invention.

A mathematical equation can be used to select an alternative material system, plus shape and length of the alternative flexible elongated device to closely match the resistance of a known device. The variables in the selection of an alternative device are: 1) flexural modulus of elasticity of the material; 2) length of the device and 3) cross-sectional shape of the device.

From page 380 of the book, "Strength of Materials" by Robert W. Fitzgerald (Addison-Wesley Publishing Co., Inc. 1967), we find the equation giving the maximum deflection of a simply supported beam with concentrated load at the center:

$$\Delta_{MAX}(\text{at center of beam})=PL^3/48EI$$

To determine the 1-cross-sectional dimensions, 2-flexural modulus of elasticity or 3-length of an alternative device, set the $\Delta_{MAX}$ for the known device equal to the $\Delta_{MAX}$ for the 'alternative design'. This gives an equation:

$$L_1/E_1I_1=L_2/E_2I_2$$

The subscript '1' is for the known device and '2' is for the alternative device. The above equation can be used to find one 'unknown' value for the alternative design by assuming values for the other values.

As an example, to find the diameter of a round rod made from the crystalline thermoplastic Delrin ($E_2$=380,000 psi and $L_2$=34.5") the above equation (using $I_2$=3.14 $R^4$/4) results in a diameter of 0.549". So, a round extruded rod made from the acetal resin, Delrin®, would need to be 0.549" in diameter to give the user the same bending stiffness as the pultruded rectangular bar (0.1875"×0.500"×34.5" with an $E_1$=6,000,000).

An alternative to the above described method follows the basic principles of the invention but uses a modified 'sit-up machine' 70 (FIG. 25) to position the flexible exercise device at the proper position 72 for contact by the front of the individual's legs above the knees 34. In this case the person's hands are left free to be positioned 71 on the sit-up machine to allow the upper body to raise upwards when the abdominal muscles 30 are contracted. Care must be taken by the individual to use the abdominal muscles, and not the muscles of the arms 8*a*, 8*b* to raise the upper body forward because use of the arms will diminish the benefit for the most effective strengthening of the abdominal muscles.

Figure 25:
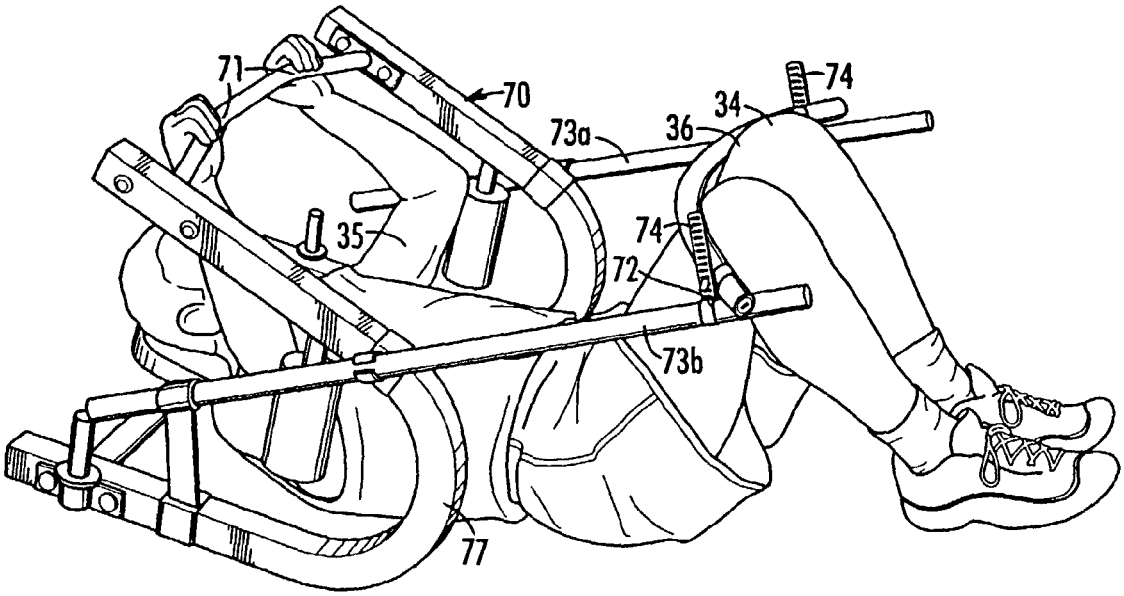
FIG. 25 shows the use of the flexible elongated device as an accessory on an abdominal roller machine.
Figure 26:
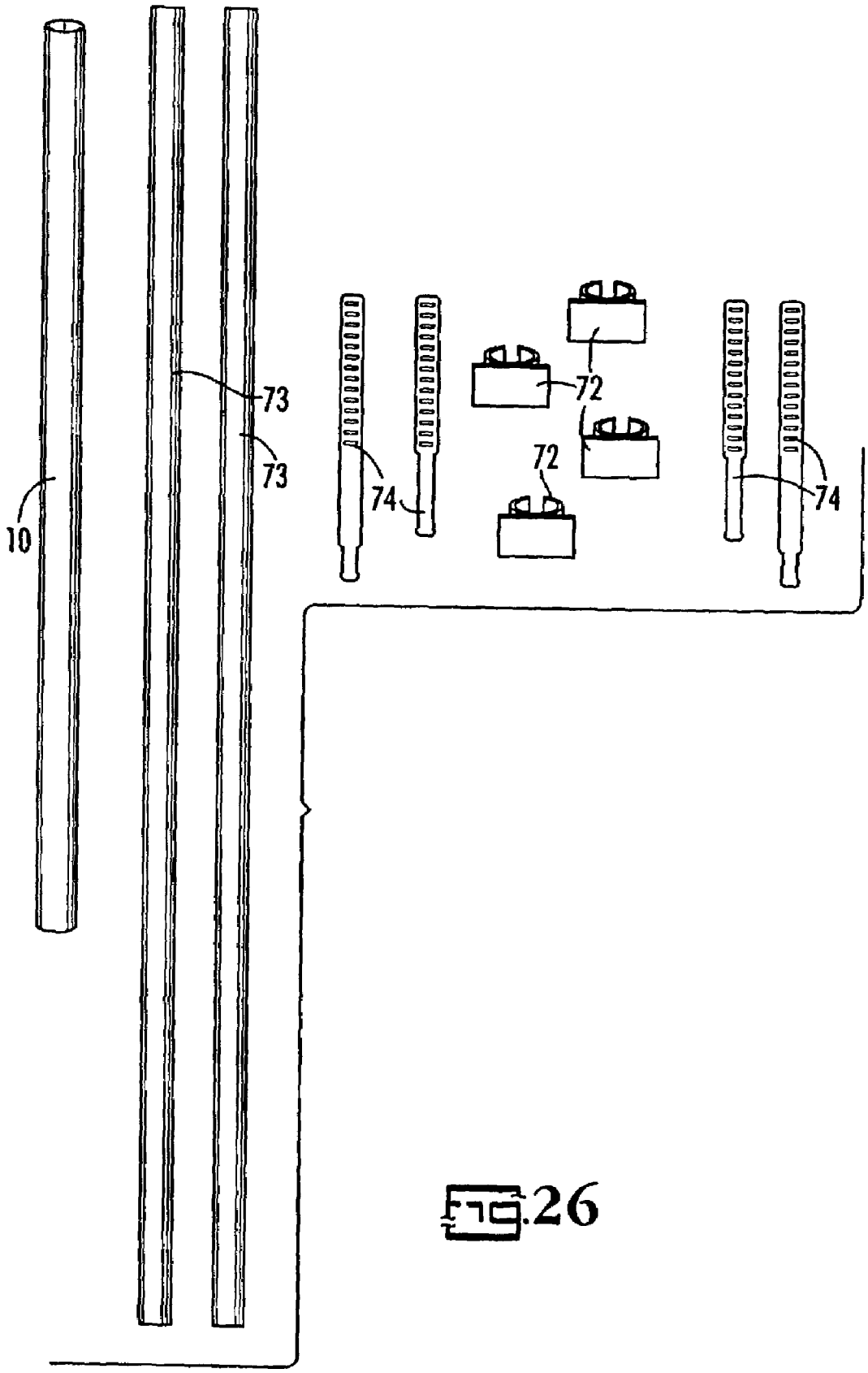
FIG. 26 shows the components for the accessory shown in FIG. 25.

There are many varieties of sit-up machines on the market today. FIG. 25 shows such a device, a ParaBody 900 ST® abdominal contractor as made by ParaBody, Inc. of Ramsey, Minn. 55303, with straight bars 73*a*, 73*b* affixed to each side of the curved portion 77 of the abdominal crunch machine at a height above the floor and angle to the floor sufficient such that the flexible exercise device can be positioned at the proper position 72 along the length of the straight bar so that the front of the individual's leg above the knees can make proper contact with the bar when the legs are raised and bent. An extension arm 74 that is at a sufficient angle to the straight bar, prevents the ends of the flexible exercise device from moving towards the individual's chest as the individual's abdominal muscles are contracted when the individual performs the sit-up and a force is exerted against the flexible device by the individual's legs at the position on the front side of legs above the knees 36*a*, 36*b*. The individual components for the kit to make these modifications is shown in FIG. 26.

It is recognized that other machine configurations could be developed by those skilled in the art without departing from the spirit and scope of the invention as expressed in the appended claims, as long as the machine allows resistance for the abdominal muscles to be created and enhanced by the use of a flexible exercise device which bends a sufficient distance as a force is resisted at each end of the flexible exercise device as one or both of the individual's knees exert a force in the opposite direction against the middle of the flexible exercise device when the distance between the individual's chest and knees is minimized in response to the contraction of the abdominal muscles.

In the drawings and the specifications, there has been set forth preferred embodiments of the invention and, although specific terms are employed, the terms are used in a generic and descriptive sense only and not for the purpose of limitation, the scope of the invention being set forth in the following claims.

What is claimed is:

1. A method of exercising the human body to firm, strengthen and tone the abdominal muscles utilizing an elongated device which is flexible when subjected to flexural bending and is substantially inflexible when subjected to compression or tension in the direction of its elongation, comprising the steps of:

a) supporting the entire body on a flat surface in a sitting position with at least one leg bent and with the upper body substantially upright;

b) grasping said elongated device with both hands such that said device is transverse to the body and the hands are spaced apart a distance on said device to allow a tailored amount of bending resistance;

c) extending the arms forward to place a section of said elongated device disposed between the hands in contact with the at least one bent leg in the front thigh region, and d) drawing the upper body toward the knee of the at least one bent leg by contracting the abdominal muscles with the straight or slightly bent arms simultaneously exerting force against the ends of the said elongated device thereby bending said elongated device against the front thigh region of the at least one bent leg which increases resistance to the contracting abdominal muscles resulting in firming, strengthening and toning of the abdominal muscles.

2. A method of exercising the human body to firm, strengthen and tone the abdominal and hip flexor muscles utilizing an elongated device which is flexible when subjected to flexural bending and is substantially inflexible when subjected to compression or tension in the direction of its elongation, comprising the steps of:

a) supporting the entire body on a flat surface in a sitting position with at-least one leg bent and with the upper body substantially upright;

b) grasping said elongated device with both hands such that the hands are spaced apart a distance on said device to provide a tailored amount of bending resistance and said device is transverse to the body;

c) extending the arms forward to place a section of said elongated device between the hands in contact with the at least one bent leg in the front thigh region; and d) drawing the upper body and the knee of the at least one bent leg toward each other at the same time by contracting the abdominal muscles and hip flexors which causes the straight or slightly bent arms to exert a force against the ends of the flexible elongated device bending said elongated device against the front thigh region of the at least one bent leg to increase resistance to the abdominal muscles and hip flexors resulting in firming, strengthening and toning of the abdominal and hip flexor muscles.

3. A method of exercising the human body to firm, strengthen and tone the abdominal muscles utilizing an elongated device which is flexible when subjected to flexural bending and is substantially inflexible when subjected to compression or tension in the direction of its elongation, comprising the steps of:

a) laying the back on a flat surface whereby straining of the back muscles is avoided with at least one leg bent;

b) grasping said elongated device with both hands such that the hands are spaced apart a distance on said device to afford a tailored amount of bending resistance and said device is transverse to the body;

c) extending the arms forward to place a section of said elongated device between the hands in contact with the at least one bent leg in the front thigh region; and d) drawing the upper body toward the knee of the at least one bent leg by contracting the abdominal muscles with the straight or slightly bend arms exerting force against the ends of the flexible elongated device thereby bending said elongated device against the front thigh region of the at least one bent leg which increases resistance to the contracting abdominal muscles resulting in firming, strengthening and toning the abdominal muscles.

4. A method of exercising the human body to firm, strengthen and tone the abdominal and hip flexor muscles utilizing an elongated device which is flexible when subjected to flexural bending and is substantially inflexible when subjected to compression or tension in the direction of its elongation, comprising the steps of:

a) laying the back on a flat surface to minimize strain on the back muscles and with at least one leg bent;

b) grasping said elongated device with both hands such that the hands are spaced apart a distance on said device to afford a tailored amount of bending resistance and said device is transverse to the body;

c) extending the arms forward to place a section of said elongated device between the hands in contact with the at least one bent leg in the front thigh region; and d) drawing both the upper body and the knee of the at least one bent leg toward each other at the same time by contracting the abdominal muscles and hip flexor muscles with the straight or slightly bent arms exerting force against the ends of the flexible elongated device bending said elongated device against the front thigh region of the at least one bent leg to increase resistance to the abdominal muscles and hip flexor muscles resulting in firming, strengthening and toning of the abdominal and hip flexor muscles.

5. A method of exercising the human body to firm, strengthen and tone the abdominal muscles utilizing an elongated device which is flexible when subjected to flexural bending and is substantially inflexible when subjected to compression or tension in the direction of its elongation, comprising the steps of:

a) supporting the entire body on a flat surface with both legs bent in a sitting position and with the upper body substantially upright;

b) grasping the central portion of said elongated device extending transverse to the body with at least one hand such that the hand is positioned near the center of the device;

c) extending the arm of the hand forward to place the two sections of said elongated device on the outside of the hand in contact with the front thigh regions, respectively, of the bent legs; and d) drawing the upper body toward the knees by contracting the abdominal muscles and simultaneously exerting a force against the central portion of said elongated device with the arm in a straight or slightly bent condition causing bending of said elongated device against the front thigh regions to increase resistance to the abdominal muscles resulting in firming, strengthening and toning of the abdominal muscles.

6. A method of exercising the human body to firm, strengthen and tone the abdominal and hip flexor muscles utilizing an elongated device which is flexible when subjected to flexural bending and is substantially inflexible when subjected to compression or tension in the direction of its elongation, comprising the steps of:

a) supporting the entire body on a flat surface in a sitting position with both legs bent and with the upper body substantially upright;

b) grasping the central portion of said elongated device extending transverse to the body with at least one hand such that the hand is positioned near the center of the device;

c) extending the arm of the at least one hand forward to place the two sections of said elongated device on the outside of the at least one hand in contact with the front thigh regions, respectively, of the bent legs; and d) drawing both the upper body and the knees toward each other at the same time by contracting the abdominal muscles and hip flexors and simultaneously exerting force with the arm of the at least one hand against the center of the flexible elongated device thereby bending said elongated device against the front thigh regions to increase resistance to the abdominal and hip flexor muscles resulting in firming, strengthening and toning of the abdominal and hip flexor muscles.

7. A method of exercising the human body to firm, strengthen and tone the abdominal and hip flexor muscles utilizing an elongated device which is flexible when subjected to flexural bending and is substantially inflexible when subjected to compression or tension in the direction of its elongation, comprising the steps of:

a) laying the back on a flat surface to minimize strain on the back muscles and with both legs bent;

b) grasping said elongated device extending transverse to the body with at least one hand such that the hand is positioned near the center of the device;

c) extending the arm of the at least one hand forward to place the two sections of said flexible elongated device on the outside of the at least one hand in contact with the front thigh regions, respectively, of the bent legs; and d) drawing both the upper body and the knees toward each other at the same time by contracting the abdominal and hip flexor muscles and simultaneously exerting force with the arm against the center of the flexible elongated device thereby bending said elongated device against the thigh regions to increase resistance to the abdominal and hip flexor muscles resulting in firming strengthening and toning of the abdominal and hip flexor muscles.

8. A method of exercising the human body to firm, strengthen and tone the abdominal muscles utilizing an elongated device which is flexible when subjected to flexural bending and is substantially inflexible when subjected to compression or tension in the direction of its elongation, comprising the steps of:

a) supporting the entire body on a flat surface in a sitting position with both legs bent and with the upper body substantially upright;

b) grasping said elongated device with both hands such that the hands are spaced apart a distance on said device to obtain a desired amount of bending resistance and said device is transverse to the body;

c) extending the arms forward in a straight or slightly bend condition to place a section of said elongated device between the hands in contact with the bent legs in the front thigh regions; and d) drawing the upper body toward the knees by contracting the abdominal muscles causing force to be exerted against the ends of said device and bending of said elongated device against the front thigh regions to increase resistance to the abdominal muscles resulting in firming, strengthening and toning of the abdominal muscles.

9. A method of exercising the human body to firm, strengthen and tone the abdominal muscles utilizing an elongated device which is flexibly arched when subjected to flexural bending, returns to its original elongated shape when released from said flexural bending and is substantially inflexible when subjected to compression or tension in the direction of its elongation, comprising the steps of:

a) laying the back on a flat surface to prevent straining of the back muscles and with both legs bent;

b) grasping said elongated device with both hands such that the hands are spaced apart a distance on said device to provide a tailored amount of bending resistance and said device is transverse to the body;

c) extending the arms forward to place a section of said elongated device between the hands in contact with the bent legs in the front thigh region; and d) drawing the upper body toward the knees by contracting the abdominal muscles and simultaneously causing the arms to exert forces against the ends of the flexible elongated device causing bending of said elongated device against the thigh regions to increase resistance to the abdominal muscles resulting in firming, strengthening and toning of the abdominal muscles.

* * * * *